US008177220B2

(12) United States Patent
Yanagishita

(10) Patent No.: US 8,177,220 B2
(45) Date of Patent: May 15, 2012

(54) FEEDING DEVICE AND PRINTING APPARATUS

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 12/473,401

(22) Filed: May 28, 2009

(65) Prior Publication Data

US 2009/0295066 A1 Dec. 3, 2009

(30) Foreign Application Priority Data

May 30, 2008 (JP) ..... 2008-142503

(51) Int. Cl.
*B65H 3/06* (2006.01)

(52) U.S. Cl. ..... 271/118; 271/117

(58) Field of Classification Search ..... 271/118, 271/117, 253, 254, 226
See application file for complete search history.

(56) References Cited

U.S. PATENT DOCUMENTS

| | | | | |
|---|---|---|---|---|
| 4,097,041 | A * | 6/1978 | Fujimoto | 271/114 |
| 4,606,536 | A * | 8/1986 | Ohara | 271/118 |
| 5,228,671 | A * | 7/1993 | Fish et al. | 271/9.09 |
| 6,547,235 | B2 * | 4/2003 | Higaki | 271/10.01 |
| 6,554,270 | B2 * | 4/2003 | Yamamoto | 271/117 |
| 2008/0116626 | A1 * | 5/2008 | Oomori | 271/109 |
| 2009/0091073 | A1 * | 4/2009 | Joyce et al. | 271/4.02 |

FOREIGN PATENT DOCUMENTS

| | | |
|---|---|---|
| JP | 2006-117393 | 5/2006 |
| JP | 2006-312504 | 11/2006 |

* cited by examiner

*Primary Examiner* — Michael McCullough
*Assistant Examiner* — Howard Sanders
(74) *Attorney, Agent, or Firm* — Maschoff Gilmore & Israelsen

(57) ABSTRACT

A feeding device includes a pickup roller that picks up a loaded feeding medium and sends the feeding medium to a downstream side of a feeding direction and a regulator that is provided at a location different from the pickup roller in a widthwise direction of the feeding medium and regulates the posture of the feeding medium by moving relative to the pickup roller so as to contact with or separate from the feeding medium and being urged in a direction of approaching the feeding medium.

2 Claims, 16 Drawing Sheets

FEEDING DEVICE AND PRINTING APPARATUS

BACKGROUND

1. Technical Field

The present invention relates to a feeding device that includes a pickup roller picking up a loaded feeding medium and sending the feeding medium to a downstream side of a feeding direction and a regulator provided at a location different from that of the pickup roller so as to regulate a posture of the feeding medium, and a printing apparatus that includes the feeding device. An example of the printing apparatus includes as an ink jet printer, a wire dot printer, a laser printer, a line printer, a copying machine, a facsimile machine, or the like.

2. Related Art

As disclosed in JP-A-2006-312504 and JP-A-2006-117393, a feeding device provided in a printing apparatus includes a pickup roller and a regulator. Among them, the pickup roller is configured to pick up a loaded feeding medium, that is, a paper sheet and to send the feeding medium to a downstream side of a feeding direction. In addition, the regulator is configured to regulate the posture of the paper sheet.

FIGS. 16A and 16B are front views illustrating a schematic configuration inside a known printing apparatus when viewed from a downstream side of a feeding direction. Here, FIG. 16A illustrates the printing apparatus disclosed in JP-A-2006-312504. FIG. 16B illustrates the printing apparatus disclosed in JP-A-2006-117393.

As shown in FIG. 16A, a feeding device 201 provided in a printing apparatus 200 disclosed in JP-A-2006-312504 includes a pickup roller 202, a holder unit 203, and regulators 204. Here, the pickup roller 202 is configured to pick up a paper sheet 205 and to send the paper sheet 205 to a downstream side of a feeding direction (direction Y). In addition, the holder unit 203 is configured to retain the pickup roller 202 so that the pickup roller 202 is movable in a direction contacting with or separating from the paper sheet 205.

The regulators 204 are integrally formed with the holder unit 203 and are disposed in the vicinity of the inside of both side ends in a widthwise direction X of the paper sheet 205 so as to regulate the posture of the paper sheet 205, that is, the uplift (simply referred to as "lift") of the paper sheet 205. That is, the regulators 204 are fixed to the holder unit 203.

In addition, when the pickup roller 202 picks up the paper sheet 205, the friction force is generated between the pickup roller 202 and the paper sheet 205. For this reason, the pickup roller 202 is urged in a direction approaching the paper sheet 205 by the holder unit 203. The urging force is referred to as the pickup urging force G ("G1" in JP-A-2006-312504 and "G2" in JP-A-2006-117393).

In JP-A-2006-312504, the pickup urging force G1 is 100 gram-weight. The pickup urging force G1 is set to generate the appropriate friction force against the paper sheet 205. Accordingly, the pickup roller 202 can pick up the uppermost paper sheet 205 and send the paper sheet 205 to a downstream side of a feeding direction. Here, the uppermost paper sheet indicates the paper sheet which is the closest to the pickup roller 202.

However, since the lift phenomenon of the paper sheet 205 indicates the state where both sides of the paper sheet are deformed due to the absorbed moisture or the like, this lift phenomenon occurs even in the case of a stiff paper sheet. In this case, the side ends of the stiff paper sheet 205 may directly contact with the regulators 204 so as to strongly push upward the holder unit. Accordingly, the pickup roller 202 may be moved away from the paper sheet 205, so that the pickup roller 202 may not pick up the paper sheet 205. This is a so-called non-feeding state.

Therefore, in JP-A-2006-117393, as shown in FIG. 16B, the pickup urging force G2 is set to 500 gram-weight sufficiently larger than that of JP-A-2006-312504 so as to push downward the lifted paper sheet 205 by using the regulators 204. In addition, since the other components are the same as those of JP-A-2006-312504, the same reference numerals are used and a detailed description thereof will be omitted.

Accordingly, even when the lift phenomenon occurs in the stiff paper sheet, it is possible to prevent the pickup roller 202 from being moved away from the paper sheet 205.

However, another problem arises. In detail, since the pickup urging force G2 is set to 500 gram-weight, the friction force between the uppermost paper sheet 205 and the following paper sheet 205 increases. Accordingly, the large feeding force may be applied to the following paper sheet 205, so that the following paper sheet 205 is simultaneously sent to a downstream side of a feeding direction. This is a so-called overlapping feeding operation. That is, when only the pickup urging force G2 is set to a large value, the pickup precision becomes unstable.

SUMMARY

An advantage of some aspects of the invention is that it provides a feeding device capable of reducing a skew of a feeding medium and of reliably performing a pickup operation on the feeding medium using a pickup roller, and a printing apparatus including the feeding device.

According to a first aspect of the invention, there is provided a feeding device including: a pickup roller that picks up a loaded feeding medium and sends the feeding medium to a downstream side of a feeding direction and a regulator that is provided at a location different from the pickup roller in a widthwise direction of the feeding medium and regulates the posture of the feeding medium by moving relative to the pickup roller so as to contact with or separate from the feeding medium and being urged in a direction of approaching the feeding medium.

With such a configuration, the feeding device includes the regulator. That is, the regulator is configured to be movable relative to the pickup roller in a direction of contacting with or separating from the paper sheet. Accordingly, the regulator is movable in a direction of moving away from the pickup roller against the urging force.

For example, when the rigidity of the feeding medium is large and the lifting force of the feeding medium is large, the regulator regulates the lift phenomenon and is retreated in a direction of moving away from the feeding medium so as to be stopped at a location where the urging force is equal to the lifting force.

Accordingly, it is possible to reduce the friction force generated between the regulator and the feeding medium as compared with the case of the related art in which the regulator is not retreated. As a result, when the feeding medium is sent to a downstream side of a feeding direction, the braking force is not applied to the feeding medium.

In addition, it is possible to reduce the pickup urging force used to urge the pickup roller against the feeding medium during the pickup operation as compared with the case of the related art in which the regulator is not retreated. As a result, it is possible to prevent the feeding medium from being overlappingly fed due to the excessively strong pickup urging force.

For example, when the regulator and the pickup roller are provided in the same pickup unit, the whole part of the pickup unit is pushed upward by the lifting force in the case of the related art in which the regulator is not retreated. In this case, the feeding force may not be applied from the pickup roller to the feeding medium. For this reason, in the related art, the pickup urging force is set to a large value. In addition, in the related art, a problem arises in that the feeding medium is overlappingly fed due to the excessively strong pickup urging force.

However, in the invention, since the regulator is retreated against the urging force, it is possible to absorb the lifting force even when the regulator and the pickup roller are provided in the same pickup unit. That is, it is possible to efficiently reduce an influence in which the lifting force affects the pickup roller and the pickup unit. As a result, as described above, it is possible to prevent the feeding medium from being overlappingly fed due to the excessively strong pickup urging force.

In addition, it is possible to regulate the posture of the feeding medium.

For example, it is possible to regulate a so-called lift phenomenon in which the side ends in a widthwise direction of the feeing medium are curled up due to the absorbed moisture or locations except for the pressed locations of the feeding medium pressed down by the pickup roller are displaced upward.

Accordingly, it is possible to remarkably reduce the posture difference in a widthwise direction of the feeding medium. As a result, it is possible to reduce the transport difference as the feeding state in a widthwise direction of the feeding medium. Also, it is possible to reduce a skew in which the feeding medium is inclined of a feeding direction.

A second aspect of the invention provides the feeding device according to the first aspect, wherein the regulator may be provided at a location facing both side ends of the feeding medium having a predetermined size in a widthwise direction of the feeding medium.

With such a configuration, in addition to the advantage of the first aspect, the regulator is disposed at locations facing both side ends in a widthwise direction of the feeding medium having a predetermined size. Accordingly, it is possible to reliably regulate the lift phenomenon of both side ends of the feeding medium.

A third aspect of the invention provides the feeding device according to the first aspect, wherein the regulator may be provided in a pickup unit so as to be movable relative to the pickup unit that movably retains the pickup roller so as to contact with or separate from the feeding medium.

With such a configuration, in addition to the advantage of the first aspect, the regulator is provided in the pickup unit so as to be movable relative to the pickup unit that movably retains the pickup roller so as to contact with or separate from the feeding medium. Accordingly, it is possible to easily provide the regulator.

In addition, since the regulator is provided in the pickup unit so as to be movable relative to the pickup unit, it is possible to absorb the lifting force by moving the regulator against the urging force. That is, it is possible to efficiently reduce the influence in which the lifting force affects the pickup roller and the pickup unit.

For example, in the case of the configuration in which the feeding medium is loaded on a cassette unit detachably attached to the feeding device, when the pickup unit is retreated from the feeding medium upon attaching or detaching the cassette unit to or from the feeding device, the regulator can be retreated at the same time. As a result, the regulator may not interfere with the attaching or detaching operation of the cassette unit.

A fourth aspect of the invention provides the feeding device according to the first aspect, wherein the regulator may be a rotatable roller.

With such a configuration, in addition to the advantage of the first aspect, the regulator is the rotatable roller. Accordingly, when the regulator contacts with the feeding medium, it is possible to reduce the friction force generated between the regulator and the feeding medium. That is, it is possible to reduce a so-called back tension, that is, a load generated when the feeding medium is sent to a downstream side of a feeding direction.

Since the friction force between the regulator and the feeding medium is reduced, it is possible to reduce the possibility of causing a defect on the feeding medium by the regulator.

In addition, since the back tension difference in a widthwise direction can be reduced by reducing the friction force between the regulator and the feeding medium, it is possible to reduce the skew.

A fifth aspect of the invention provides the feeding device according to the first aspect, wherein a location of the regulator on the side of the feeding medium may be retreated further from the feeding medium than a location of the pickup roller on the side of the feeding medium in the direction of contacting with or separating from the feeding medium.

With such a configuration, in addition to the advantage of the first aspect, the location of the regulator on the side of the feeding medium is retreated further from the feeding medium than the location of the pickup roller on the side of the feeding medium in the direction of contacting with or separating from the feeding medium. Accordingly, when the lift phenomenon does not occur in the feeding medium, the regulator does not act on the feeding medium. That is, when it is not necessary to regulate the posture of the feeding medium, the regulation operation is not carried out. On the other hand, when the lift phenomenon occurs in the feeding medium, the regulator acts on the feeding medium. That is, the regulation operation is carried out only when it is necessary to regulate the posture of the feeding medium.

A sixth aspect of the invention provides the feeding device according to the first aspect, wherein an urging force that urges the regulator may be variable.

With such a configuration, in addition to the advantage of the first aspect, the urging force that urges the regulator is variable. For example, it is possible to change the urging force in accordance with the type of the feeding medium. Accordingly, it is possible to appropriately set the urging force in accordance with the type of the feeding medium.

A seventh aspect of the invention provides the feeding device according to the first aspect, wherein the feeding device may further comprise a guide path section that guides the feeding medium sent by the pickup roller, and wherein the guide path section may be formed in a U-shape when viewed from a side.

With such a configuration, in addition to the advantage of the first aspect, the feeding device further comprises the guide path section that guides the feeding medium sent by the pickup roller, and the guide path section is formed in a U-shape when viewed from a side. The feeding device is of a so-called front feed type in which a long guide path is detoured.

The front feed type has a long guide path compared with a so-called rear feed type in which a short guide path is formed in a substantially straight line. In the case of the long guide path, the skew is apt to occur. In this case, the regulator is particularly effective.

In addition, in the case of the feeding medium of A3 size or more, the feeding medium is located throughout the U-shaped path. For this reason, the transport difference in a widthwise direction is apt to occur due to the lift phenomenon and the skew is apt to occur. In this case, the regulator is particularly effective.

According to an eighth aspect of the invention, there is provided a printing apparatus including: a feeder that picks up and feeds a loaded feeding medium; a transporter that transports the feeding medium toward a downstream side in a transportation direction; and a printer that performs a printing operation on the transported feeding medium using a printing head, wherein the feeder includes the feeding device according to the first aspect.

With such a configuration, the feeder includes the feeding device according to the first aspect. Accordingly, in the printing apparatus, it is possible to obtain the advantage of the first aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings.

Figure 1:
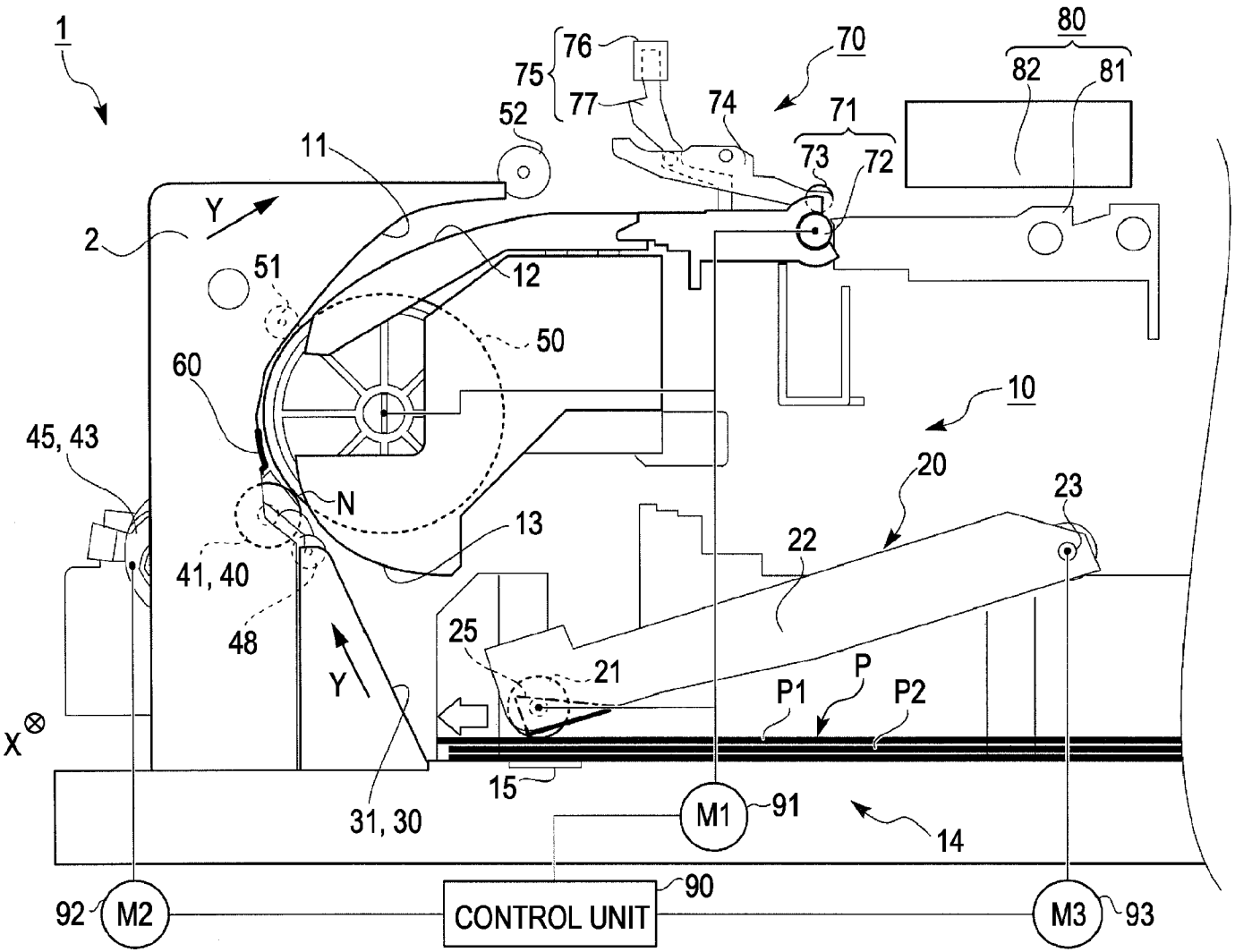
FIG. 1 is a side view illustrating a pickup operation inside a printer according to the invention.

FIG. 1 is a side view illustrating a pickup operation inside an ink jet printer (hereinafter, referred to as "a printer") 1 as an example of "a printing apparatus" or "a liquid ejecting apparatus".

Here, a liquid ejecting apparatus is not limited to a printing apparatus, such as an ink jet printing apparatus, a copying machine, and a facsimile machine, which performs a printing operation on a recording material such as a recording paper sheet by ejecting ink from a printing head as a liquid ejecting head to the recording material, and includes an apparatus for attaching liquid to an ejecting material by ejecting a liquid corresponding to a specific purpose instead of ink from a liquid ejecting head corresponding to the above-described printing head to the ejecting material corresponding to a recording material.

In addition to the above-described printing head, a liquid ejecting head includes a color-material ejecting head used in production of a color filter for a liquid crystal display, etc., an electrode-material (conductive paste) ejecting head used in formation of an electrode for an organic EL display, a field emission display (FED), etc., a bioorganic-substance ejecting head used in production of a biochip, and a sample ejecting head ejecting a sample as a precision pipette.

As illustrated in FIG. 1, the printer 1 includes a feeding unit 10, a transport unit 70, a printing unit 80, and a discharge unit (not shown). The feeding unit 10 includes a pickup unit 20, a preliminary separation unit 30, and a main separation unit 40. The pickup unit 20 is provided to pick up a paper sheet P loaded on a cassette unit 14 and send the paper sheet P to a downstream side of a feeding direction.

In more detail, the pickup unit 20 includes a pickup roller 21 driven by power of a feeding motor 91 that is an example of a drive source and an arm unit 22 retaining the pickup roller 21 so as to swing the pickup roller 21 about an arm shaft 23. The pickup roller 21 is urged in a direction of approaching the paper sheet P by an urging unit (not shown). The arm unit 22 is swung by a pickup retreating unit (not shown) so that the pickup roller 21 is moved in a direction of separating from the loaded paper sheet P. This is referred to as a pickup release operation.

The preliminary separation unit 30 includes a bank separation unit 31 that separates a bank. The operation of the preliminary separation unit 30 will be described later.

The main separation unit 40 is provided on a downstream side of a feeding direction of the preliminary separation unit 30. The main separation unit 40 has a retard roller 41 rotated by a predetermined load. The retard roller 41 forms a pair with a middle drive roller 50 driven by power of a feeding motor 91. The retard roller 41 contacts with or separates from the middle drive roller 50 by a swing mechanism 43 (refer to FIG. 5). In more detail, the swing mechanism 43 retains the retard roller 41 with a retard holder 42 (refer to FIG. 5) and is swung about a swing shaft 46 (refer to FIG. 5).

One end of an urging spring 47 (refer to FIG. 5) engages with a base body 2, and the other end thereof engages with a free end of the retard holder 42. Therefore, the retard roller 41 is urged in a direction of approaching the middle drive roller 50. The swing mechanism 43 has a cam 45 driven by power of a separating motor 92 as a means for separating the retard roller 41 from the middle drive roller 50 against the urging force of the urging spring 47. The cam 45 engages with a convex portion (not shown) of the retard holder 42 to constitute a recess cam mechanism and separates the retard roller 41 from the middle drive roller 50 using the retard holder 42.

A first driven assist roller 48 is provided between the bank separation unit 31 and the retard roller 41. The first assist roller 48 smoothly guides the tip end of the paper sheet P that has passed through the bank separation unit 31 to a nip point N between the retard roller 41 and the middle drive roller 50.

Paper sheet tip end regulation ribs 60 to be described later are provided on a downstream side of a feeding direction of the nip point N between the retard roller 41 and the middle drive roller 50.

A second assist roller 51 rotatably retained by the base body 2 and circumscribing the middle drive roller 50 is provided on a further downstream side of a feeding direction. A third assist roller 52 is rotatably provided on a still further downstream side of a feeding direction.

Here, the feeding path of the paper sheet P is formed in a U-shape from the pickup unit 20 to the transport unit 70. In more detail, the U-shaped feeding path is formed by a U-shaped outer paper sheet guide unit 11 guiding the paper sheet P from the U-shaped outside, an inner paper sheet guide unit 12 guiding the paper sheet P from the inside, the bank prevention unit 31, and an introduction prevention unit 13 to be described later.

Accordingly, the frictional resistance generated between the paper sheet P and the U-shaped outer paper sheet guide unit 11 of the base body 2 can be reduced by the first to third assist rollers 48, 51, and 52. Therefore, the paper sheet P can be smoothly sent to the transport unit 70 on the further downstream side of a feeding direction.

The transport unit 70 has a transport roller unit that transports the paper sheet P. The transport roller unit 71 has a drive transport roller 72 driven by the power of the feeding motor 91 and a driven transport roller 73. The driven transport roller 73 is rotatably retained by a driven roller holder 74.

The driven roller holder 74 presses the driven transport roller 73 against the drive transport roller 72 by means of an urging unit (not shown). A paper sheet detector that detects the paper sheet P is provided in the vicinity of an upstream side of the transport roller unit 71 in the feeding direction Y. In more detail, the paper sheet detector 75 has a swingable paper sheet detection lever 77 and a sensor 76. One end of the paper sheet detection lever swings while contacting with the paper sheet P and the other end of the paper sheet detection lever 77 goes far away from a light emitting section and a light receiving section (not shown) of the sensor 76, so that the paper sheet detector 75 is turned into an ON state.

The transport unit 70 is provided to transport the paper sheet P to the printing unit 80 provided on a downstream side of a feeding direction.

The printing unit 80 has a printing head 82 that performs a printing operation by ejecting ink to the paper sheet P and a platen 81 that faces the printing head 82 and supports the paper sheet P from the lower side.

Thereafter, the printed paper sheet P is discharged to a discharge tray (not shown) on the front surface of the printer 1 by a discharge roller of a discharge unit (not shown).

Hereinafter, a paper sheet feeding operation will be described in more detail.

As illustrated in FIG. 1, when the pickup roller 21 loaded on the cassette unit 14 picks up the uppermost paper sheet P1, the control unit 90 swings the arm unit 22 to allow the pickup roller 21 to contact with the uppermost paper sheet P1. The pickup roller 21 is rotated in a clockwise direction of the drawing by driving the arm motor 93.

Then, the pickup roller 21 is urged in a direction of approaching the paper sheet P by an urging unit (not shown). Therefore, the frictional force between the pickup roller 21 and the uppermost paper sheet P1 can generate a feeding force for sending the uppermost paper sheet P1 to a downstream side of a feeding direction. Then, the uppermost paper sheet P1 starts to move toward a downstream side of a feeding direction by a feeding force. In other words, the uppermost paper sheet P1 is picked up to be sent to a downstream side of a feeding direction.

When the friction coefficient between the pickup roller 21 and the uppermost paper sheet P1 is $\mu 1$, the friction coefficient between the paper sheets P is $\mu 2$, and the friction coefficient between the pad 15 provided at a location facing the pickup roller 21 of the base body and the paper sheet P is $\mu 3$, the friction coefficient $\mu 1$ is larger than the friction coefficient $\mu 3$ and the friction coefficient $\mu 3$ is larger than the friction coefficient $\mu 2$. Therefore, a problem of sending several paper sheets P at once can be reduced. That is, an overlappingly feeding operation can be reduced.

When the paper sheet P is picked up, the retard roller 41 approaches the middle drive roller 50.

Figure 2:
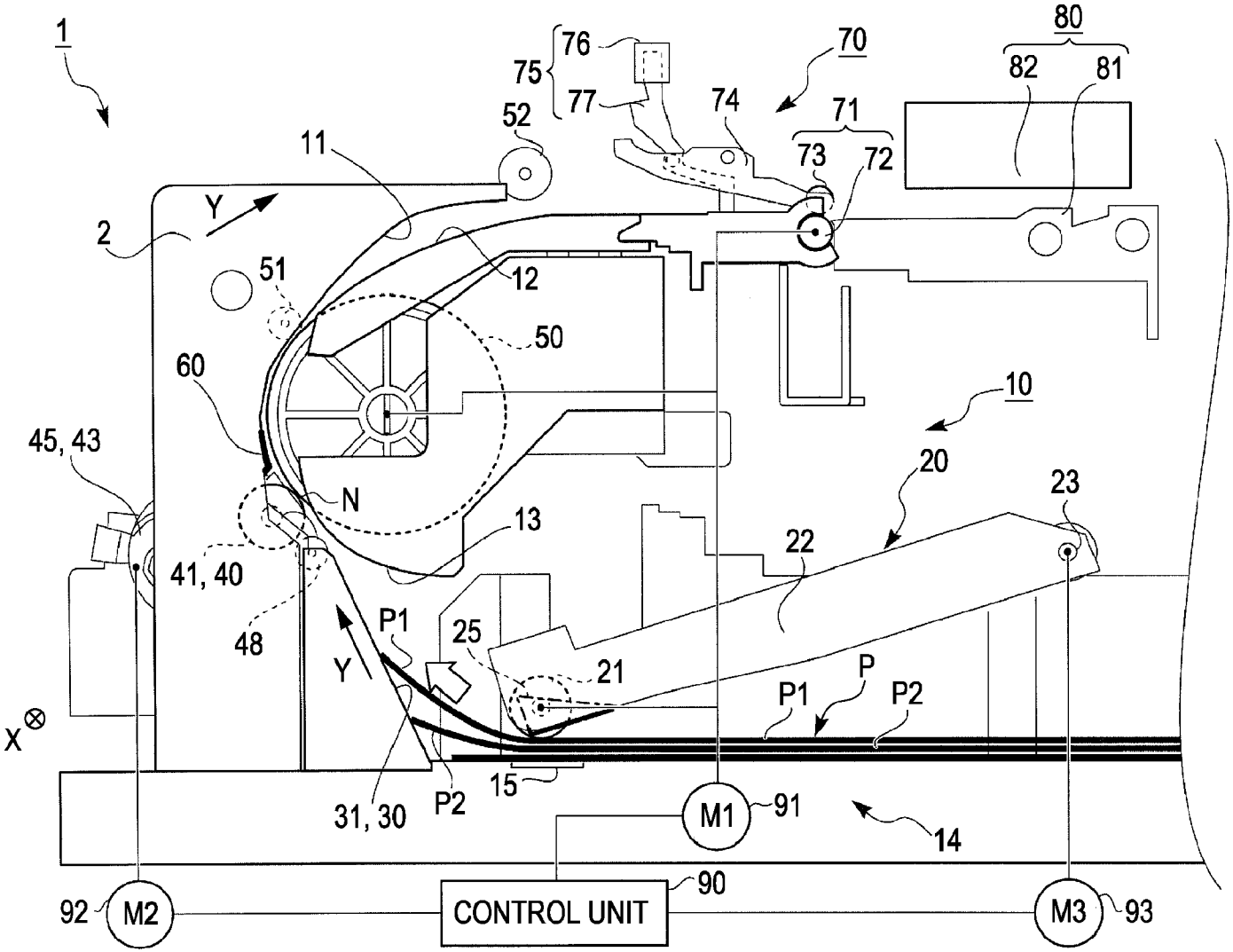
FIG. 2 is a side view illustrating a bank separation operation inside the printer according to the invention.

FIG. 2 is a side view illustrating a bank separation operation inside the printer according to the invention.

As illustrated in FIG. 2, the paper sheet P picked up by the pickup roller 21 is sent to a downstream side of a feeding direction. The sent paper sheet P enters the bank separation unit 31 as the preliminary separation unit 30.

Here, the friction coefficient $\mu 2$ between the uppermost paper sheet P1 and the following paper sheet P2 and the urging force of urging the pickup roller 21 may generate a feeding force on the following paper sheet P2. At this time, the uppermost paper sheet indicates the paper sheet which is the closest to the pickup roller 21.

In this case, not only the uppermost paper sheet P1 but also the following paper sheet P2 are sent to a downstream side of a feeding direction by the pickup roller 21.

Accordingly, in order to separate the overlappingly fed following paper sheet P2 from the uppermost paper sheet P1, the paper sheet P enters the bank separation unit 31 provided at an angle by which the posture of the tip end of the paper sheet P is displaced. The following paper sheet P2 is stopped by bringing the tip end of the paper sheet P into contact with the bank separation unit 31. Moreover, an aperture may be formed between the uppermost paper sheet P1 and the following paper sheet P2. Therefore, the overlappingly fed following paper sheet P2 can be moved away from the uppermost paper sheet P1.

Figure 3:
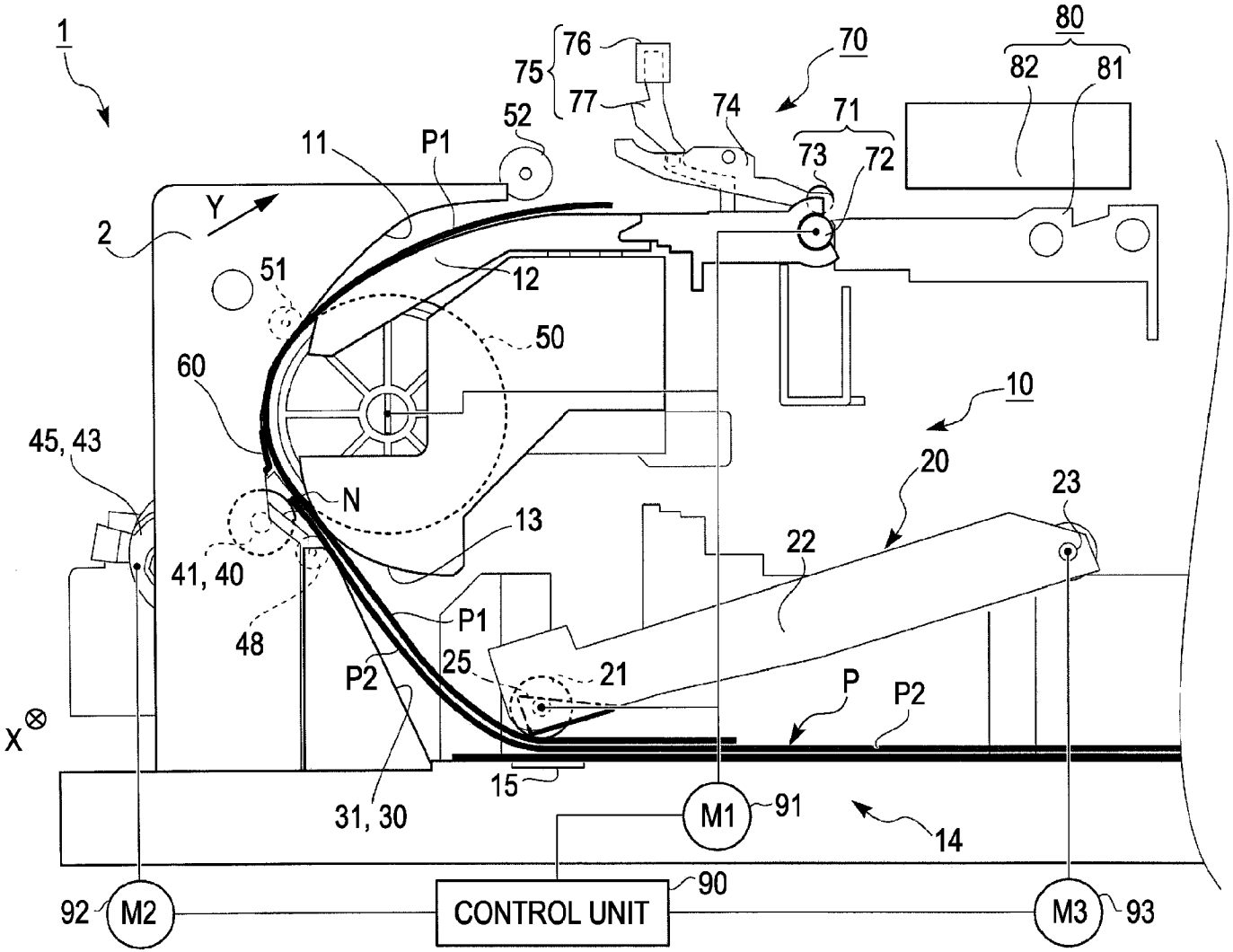
FIG. 3 is a side view illustrating a retard separation operation inside the printer according to the invention.

FIG. 3 is a side view illustrating a retard separation operation inside the printer according to the invention.

As illustrated in FIG. 3, the paper sheet P moved away by the bank separation unit 31 is sent further to a downstream side of a feeding direction by the pickup roller 21. The paper sheet P is sent to a nip point N where the retard roller 41 as the main separation unit 40 and the middle drive roller 50 circumscribe each other.

In the embodiment of the invention, since the preliminary separation unit 30 is only a preliminary separation means, it is assumed that several paper sheets P may be overlappingly fed in the main separation unit 40. Hereinafter, it will be assumed that several paper sheets P are overlappingly fed.

When the overlappingly fed paper sheet P is sent to the nip point N, only the uppermost paper sheet P1 directly contacts with the middle drive roller 50. The tip end of the following paper sheet P2 contacts with the retard roller 41 accompanying a predetermined load during the rotation thereof.

Here, when the friction coefficient between the middle drive roller 50 and the uppermost paper sheet P1 is $\mu 4$, the friction coefficient between the paper sheets P is $\mu 2$, and the friction coefficient between the retard roller 41 and the paper sheet P is $\mu 5$, the friction coefficient $\mu 4$ is larger than the friction coefficient $\mu 2$ and the friction coefficient $\mu 5$ is larger than the friction coefficient $\mu 2$.

Therefore, the feeding force applied to the uppermost paper sheet P1 can be larger than the feeding force applied to the following paper sheet P2.

Here, the load of the retard roller 41 is larger than the feeding force applied to the following paper sheet P2.

Therefore, only the uppermost paper sheet P1 can be sent to a downstream side of a feeding direction by rotating the middle drive roller 50 in a clockwise direction of the drawing.

In more detail, the tip end of the following paper sheet P2 is retained at the nip point N by the load of the retard roller 41, thereby generating a slip between the uppermost paper sheet P1 and the following paper sheet P2. Therefore, the uppermost paper sheet P1 can be separated from the following paper sheet P2 to be sent to a downstream side of a feeding direction. The tip end of the uppermost paper sheet P1 passes through the second assist roller 51 and arrives at the third assist roller 52 after being guided by the U-shaped outer paper sheet guide unit 11 and the inner paper sheet guide unit 12.

Figure 4:
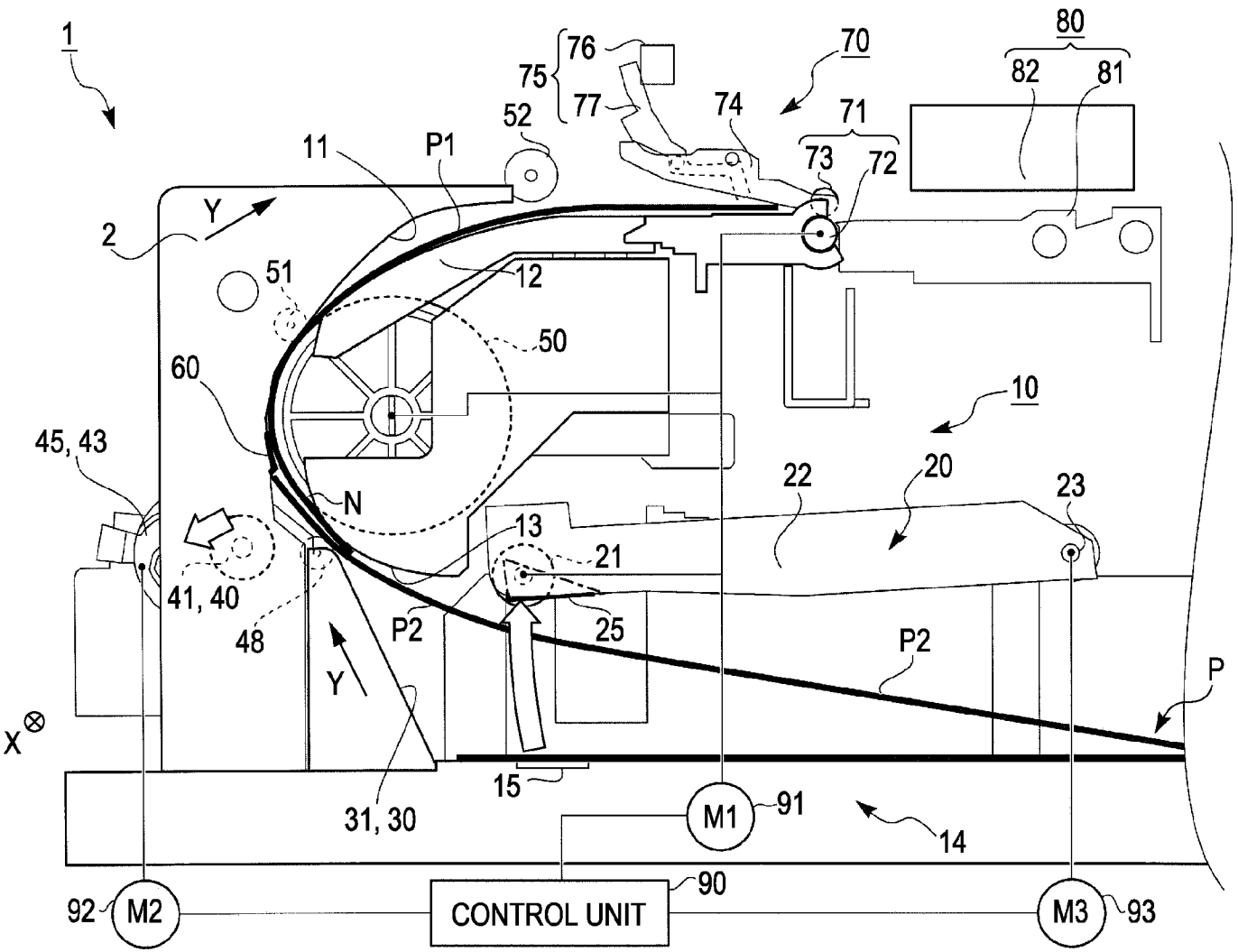
FIG. 4 is a side view illustrating the retard separation operation inside the printer according to the invention.
Figure 5:
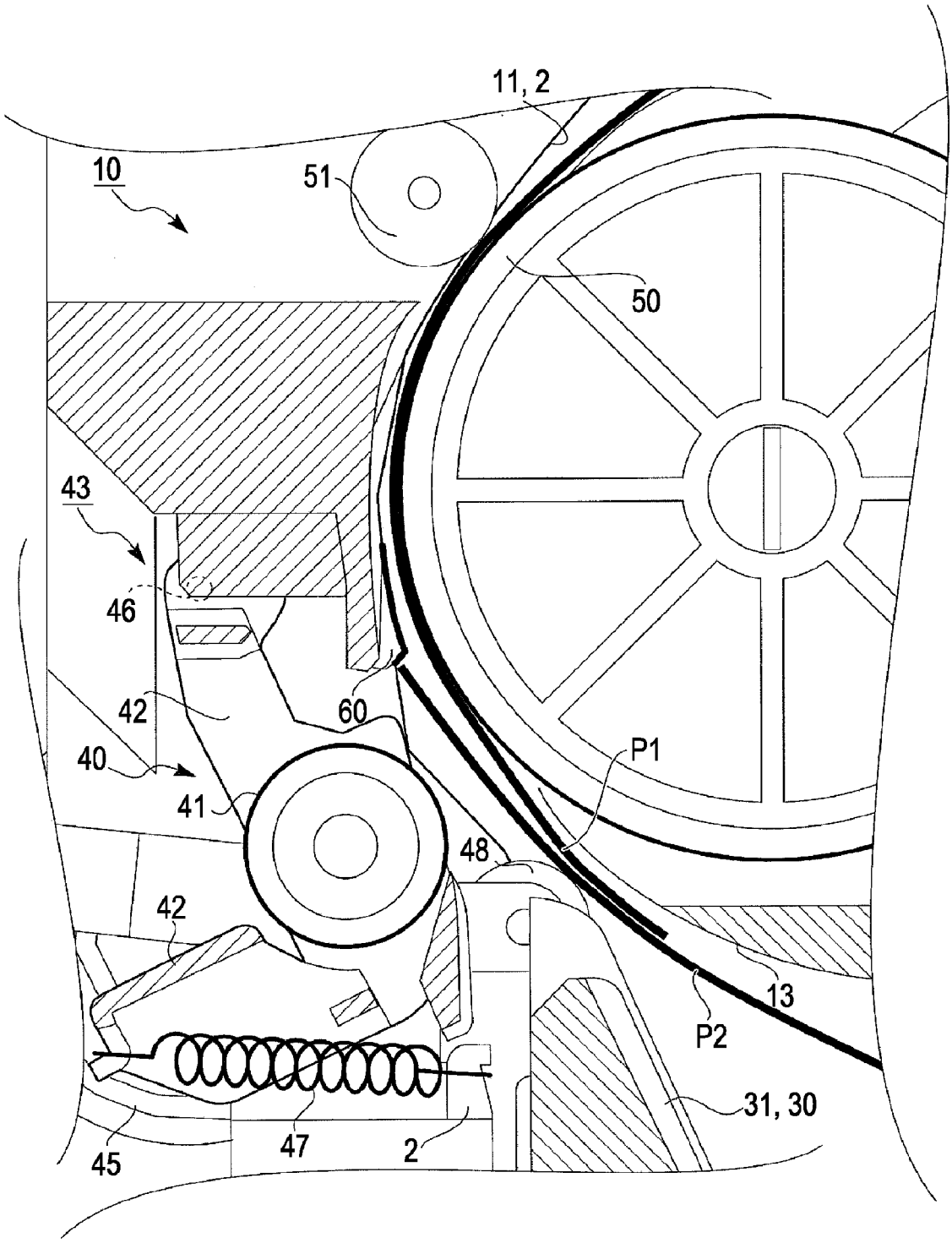
FIG. 5 is an enlarged sectional view illustrating a state of FIG. 4.

FIG. 4 is a side view illustrating the retard separation operation inside the printer according to the invention. FIG. 5 is an enlarged sectional view illustrating the state of FIG. 4.

As illustrated in FIGS. 4 and 5, when the uppermost paper sheet P1 is sent further toward a downstream side of a feeding direction with respect to the middle drive roller 50, the tip end of the uppermost paper sheet P1 is detected by the paper sheet detector 75. In more detail, the tip end of the uppermost paper sheet P1 contacts with one end of the paper sheet detection lever 77 to swing the paper sheet detection lever 77. Then, since the other end of the paper sheet detection lever 77 goes far away from the light emitting section and the light receiving section of the sensor 76, the paper sheet detector 75 is turned into an ON state.

While this functioning as a trigger, the control unit 90 separates the retard roller 41 from the middle drive roller 50. In more detail, a separating motor 92 rotates the cam 45 to swing the retard holder 42 in a direction of retreating the retard holder 42 from the middle drive roller 50 against the urging force of the urging spring 47.

The control unit 90 drives the arm motor 93, and swings the arm unit 22 about the arm shaft 23 in a direction of retreating the pickup roller 21 from the paper sheet P loaded on the cassette unit 14.

The timing of staring to separate the retard roller 41 may be a time point when the middle drive roller 50 and the pickup roller 21 reach a predetermined amount of rotation.

When the retard roller 41 is moved away, the uppermost paper sheet P1 is sent by the middle drive roller 50 and the second assist roller 51.

In addition, when the pickup roller 21 is moved away, a feeding force is not directly applied to the following paper sheet P2 from the middle drive roller 50 and the pickup roller 21. Therefore, the following paper sheet P2 of which the tip end is retained by the retard roller 41 tends to return to the cassette unit 14 by its weight.

Meanwhile, the rear end of the preceding uppermost paper sheet P1 fed by the middle drive roller 50 contacts with the tip end of the following paper sheet P2 of which the tip end is retained by the retard roller 41. Therefore, a feeding force is indirectly applied to the following paper sheet P2.

Accordingly, the convex paper sheet tip end regulation ribs 60 are provided on a downstream side of a feeding direction of the nip point N of the middle drive roller 50 and the retard roller 41 in the U-shaped outer paper sheet guide unit 11. The paper sheet tip end regulation ribs 60 are provided in the vicinity of both sides of the retard roller 41 in a widthwise direction X of the paper sheet P.

Since the feeding path is curved in a U-shape, when the retard roller 41 is moved away, the tip end of the following paper sheet P2 is displaced toward the U-shaped outer paper sheet guide unit 11.

Therefore, the paper sheet tip end regulation ribs 60 can contact with the tip end of the following paper sheet P2 to regulate the displacement of the following paper sheet P2 toward a downstream side of a feeding direction after the retard roller 41 is moved away.

In other words, the following paper sheet P2 is reliably prevented from being sent toward a downstream side of a feeding direction. As a result, the following paper sheet P2 is prevented from being supplied by the pulling force of the preceding paper sheet P1. The accompanied supply of the preceding paper sheet P1 and the following paper sheet P2 is apt to occur when the contact area between the following paper sheet P2 and the preceding paper sheet P1 is large, that is, particularly when the paper sheet P of a large size is fed. In more detail, this phenomenon is apt to occur in the paper sheet of A3 size or more. In other words, when the paper sheet is equal to or less than A4 size, since the contact area is small, the possibility of accompanied supply can be reduced.

Then, the deflection of the following paper sheet P2 can be reduced by moving the pickup roller 21 away. In other words, the posture of the following paper sheet P2 can be made as straight as possible. Therefore, the tip end of the following paper sheet P2 may actively collide with the paper sheet tip end regulation ribs 60.

The rear end of the preceding paper sheet P1 pushes the tip end of the following paper sheet P2 toward the outside of the U-shaped path as the U-shaped outer paper sheet guide unit. Therefore, the tip end of the following paper sheet P2 can actively contact with the paper sheet tip end regulation ribs 60.

As a result, the accompanied supply of the paper sheet can be reliably prevented. In other words, the accompanied supply of the paper sheet can be prevented without using a known retracting lever.

In addition, the retard roller 41 can be moved away at the timing earlier as in the related art. As a result, a backlash due to a load of the retard roller 41 can be reduced at an earlier timing. For example, the retard roller 41 may start to move away when the tip end of the uppermost paper sheet P1 reaches the second assist roller 51.

Figure 6:
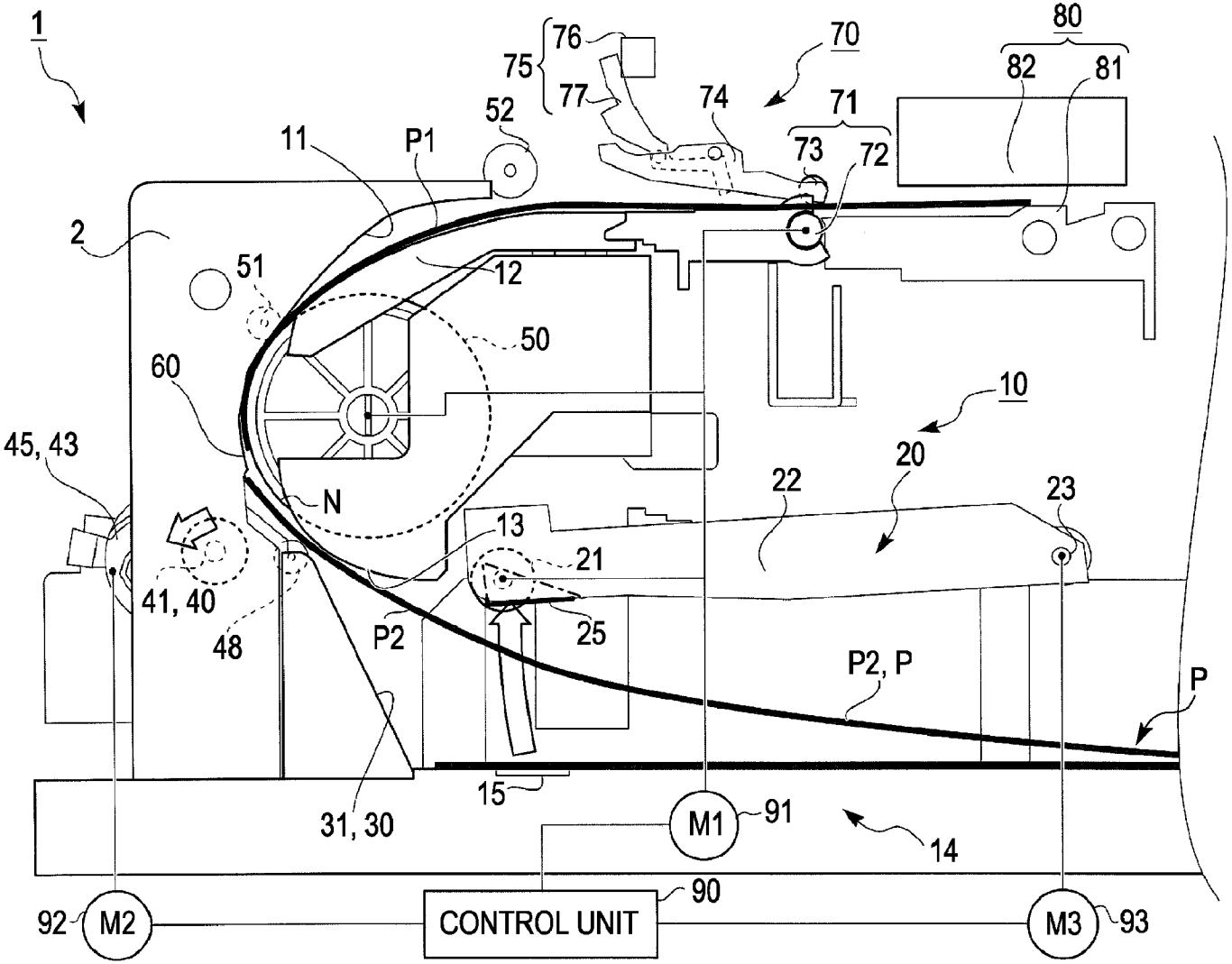
FIG. 6 is a side view illustrating the retard separation operation inside the printer according to the invention.

FIG. 6 is a side view illustrating the retard separation operation in the printer according to the invention.

As illustrated in FIG. 6, when the preceding uppermost paper sheet P1 is sent to a downstream side of a feeding direction of the middle drive roller 50 further than in FIG. 5, the rear end of the preceding paper sheet P1 passes between the middle drive roller 50 and the retard roller 41.

Here, an introduction prevention unit 13 is provided inside the U-shaped path. In more detail, the introduction prevention unit 13 is provided on a downstream side of a feeding direction of the nip point N of the middle drive roller 50 and the retard roller 41 in the feeding direction Y to cover the middle drive roller 50. Therefore, the introduction prevention unit 13 prevents the following paper sheet P2 from contacting with the middle drive roller 50. As a result, the middle drive roller 50 can directly apply a feeding force to the following paper sheet P2.

The tip end of the preceding paper sheet P1 is nipped by the transport roller unit 71. Then, after the skew removal is carried out, the preceding paper sheet P1 is transported toward a downstream side of a feeding direction by the transport roller unit 71 and is printed by the printing unit 80. Then, the preceding paper sheet P1 is discharged to a discharge tray (not shown) on the front side of the printer 1 by a discharge unit (not shown).

Figure 7:
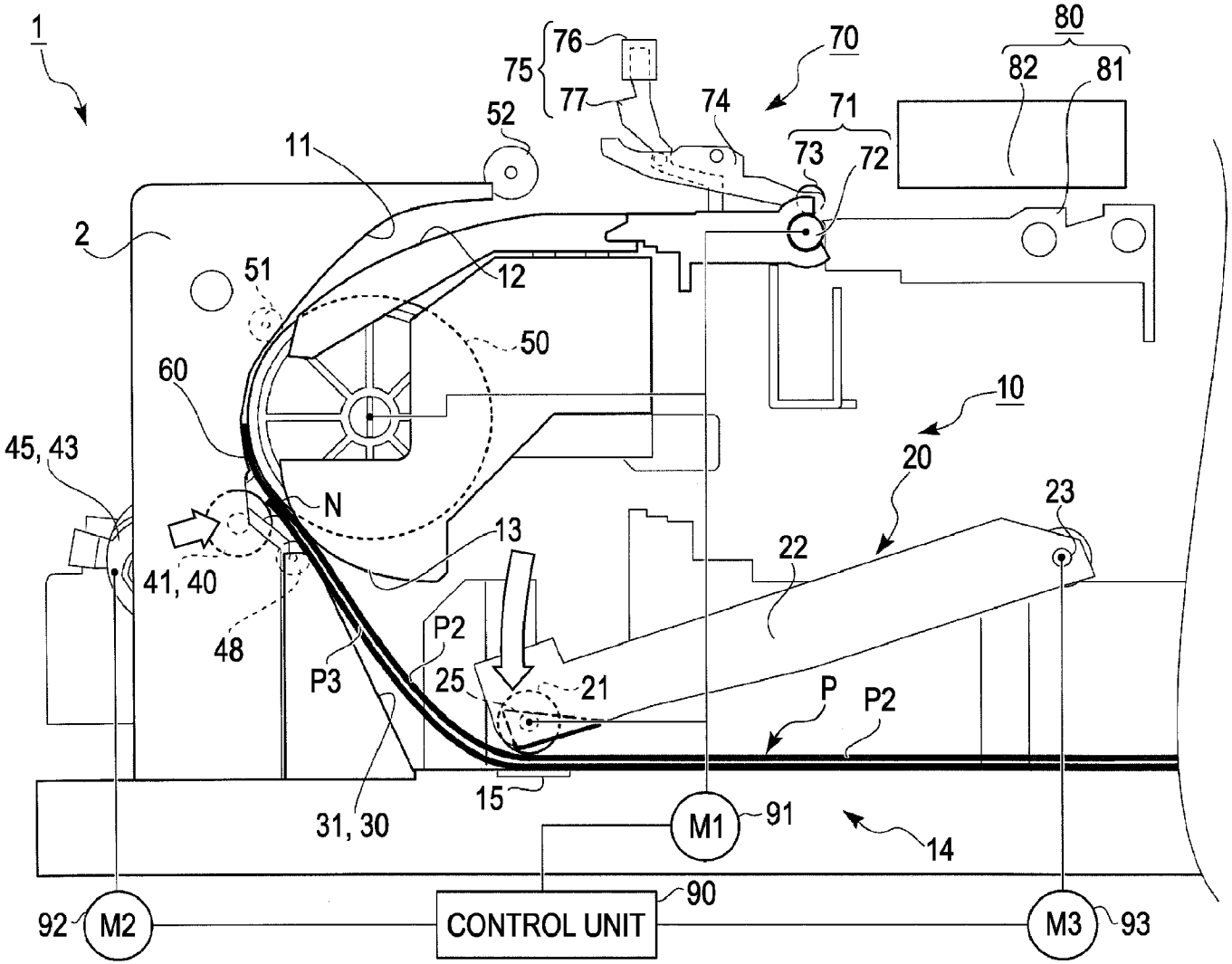
FIG. 7 is a side view illustrating an operation of picking up a following paper sheet according to the invention.
Figure 8:
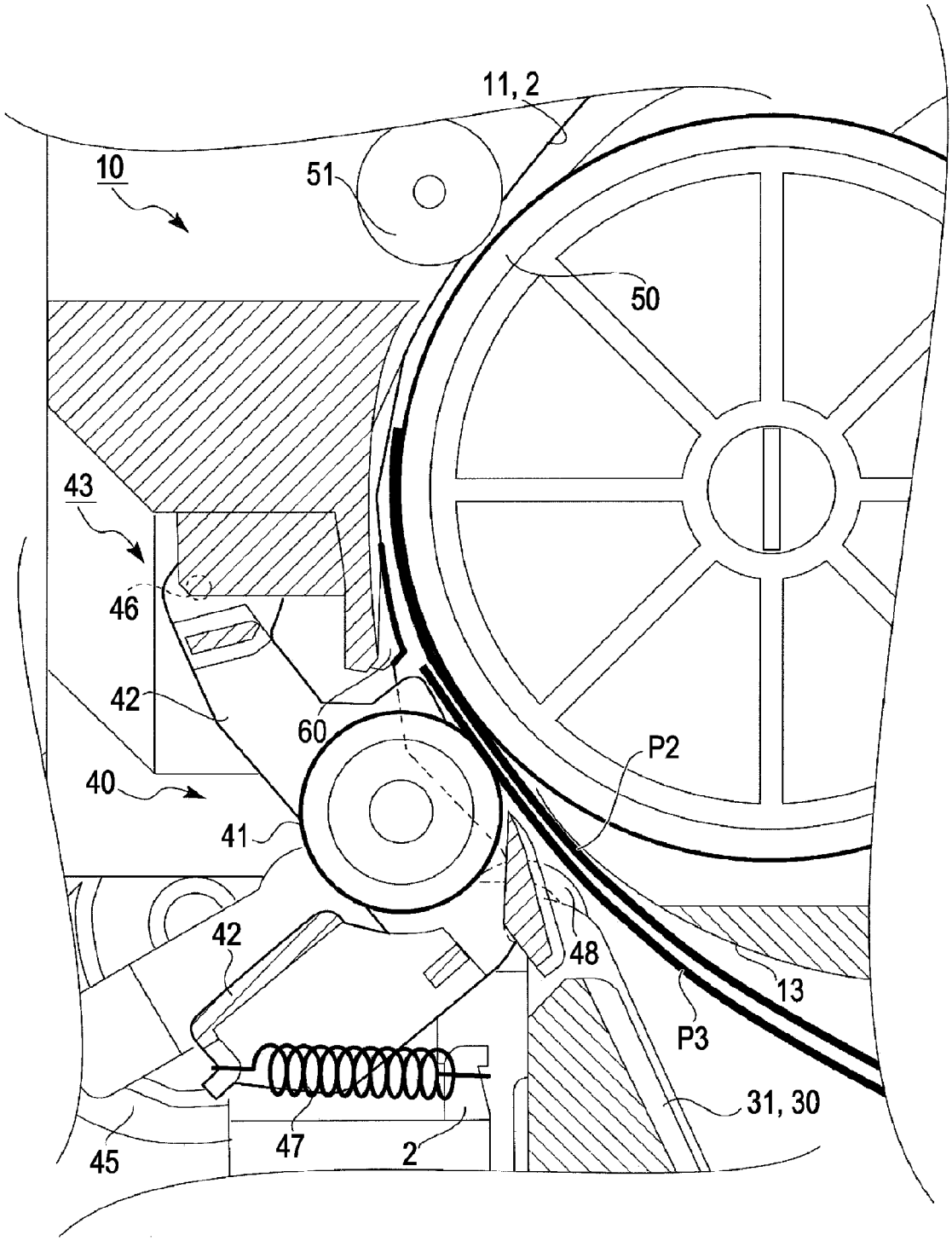
FIG. 8 is an enlarged sectional view illustrating a state of FIG. 7.

FIG. 7 is a side view illustrating an operation of picking up the following paper sheet according to the invention. FIG. 8 is an enlarged sectional view illustrating the state of FIG. 7.

As illustrated in FIGS. 7 and 8, after the preceding paper sheet P1 is transported to the printing unit 80, the paper sheet P can be continuously fed. In detail, the control unit 90 moves the retard roller 41 toward the middle drive roller 50. In more detail, the retard holder 42 is swung in a direction of approaching the middle drive roller 50 using the urging force of the urging spring 47 by rotating the cam 45 using the separating motor 92.

The control unit 90 drives the arm motor 93 and swings the arm unit 22 about the arm shaft 23 in a direction in which the pickup roller 21 approaches the paper sheet P loaded on the cassette unit 14.

Then, the following paper sheet P2 retained by the paper sheet tip end regulation ribs 60 is displaced toward the middle drive roller 50 by the approaching movement of the retard roller 41. The following paper sheet P2 is nipped by the middle drive roller 50 and the retard roller 41. Therefore, the tip end of the following paper sheet P2 is released from the regulation state of the paper sheet tip end regulation ribs 60. In this state, as described above, the middle drive roller 50 and the pickup roller 21 are rotated in a clockwise direction of the drawing.

Then, when one following paper sheet P2 is retained in the paper sheet tip end regulation ribs 60, the following paper sheet P2 is sent to a downstream side of a feeding direction.

On the other hand, as described above, when several paper sheets P2, P3, . . . are retained in the paper sheet tip end regulation ribs 60, the friction coefficient μ4 is larger than the friction coefficient μ2 and the friction coefficient μ5 is larger than the friction coefficient μ2.

Therefore, the feeding force applied to the uppermost paper sheet P2 which is the closest to the middle drive roller 50 can be larger than the feeding force applied to the following paper sheet P3. In other words, only the uppermost paper sheet P2 can be sent to a downstream side of a feeding direction by separating the following paper sheet P3 using the retard roller 41. Then, as described above, since the tip end of the uppermost paper sheet P2 is displaced toward the middle drive roller 50 by the approaching movement of the retard roller 41, the tip end is not regulated by the paper sheet tip end regulation ribs 60.

Figure 9:
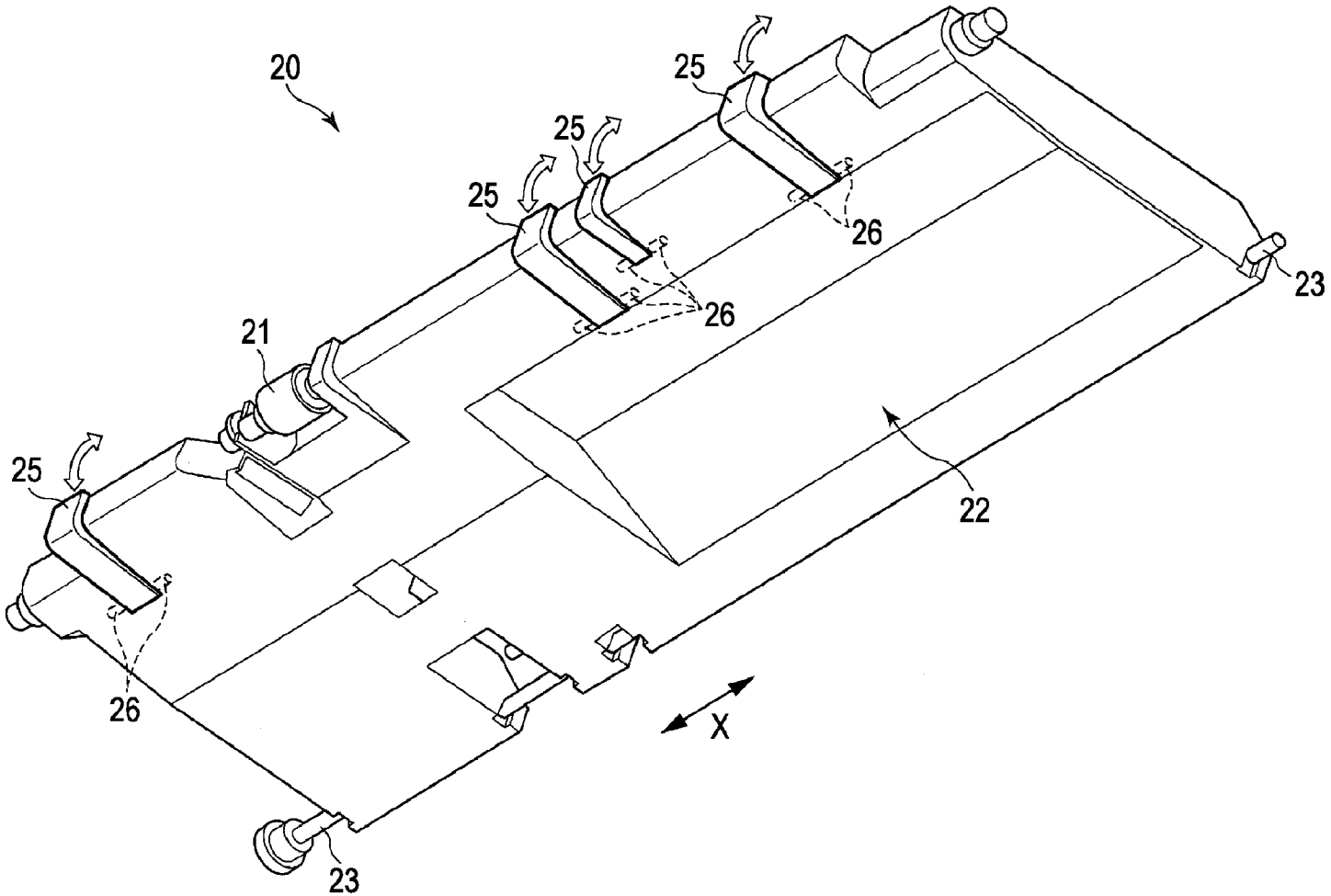
FIG. 9 is an overall bottom perspective view illustrating an arm unit according to the invention.
Figure 10:
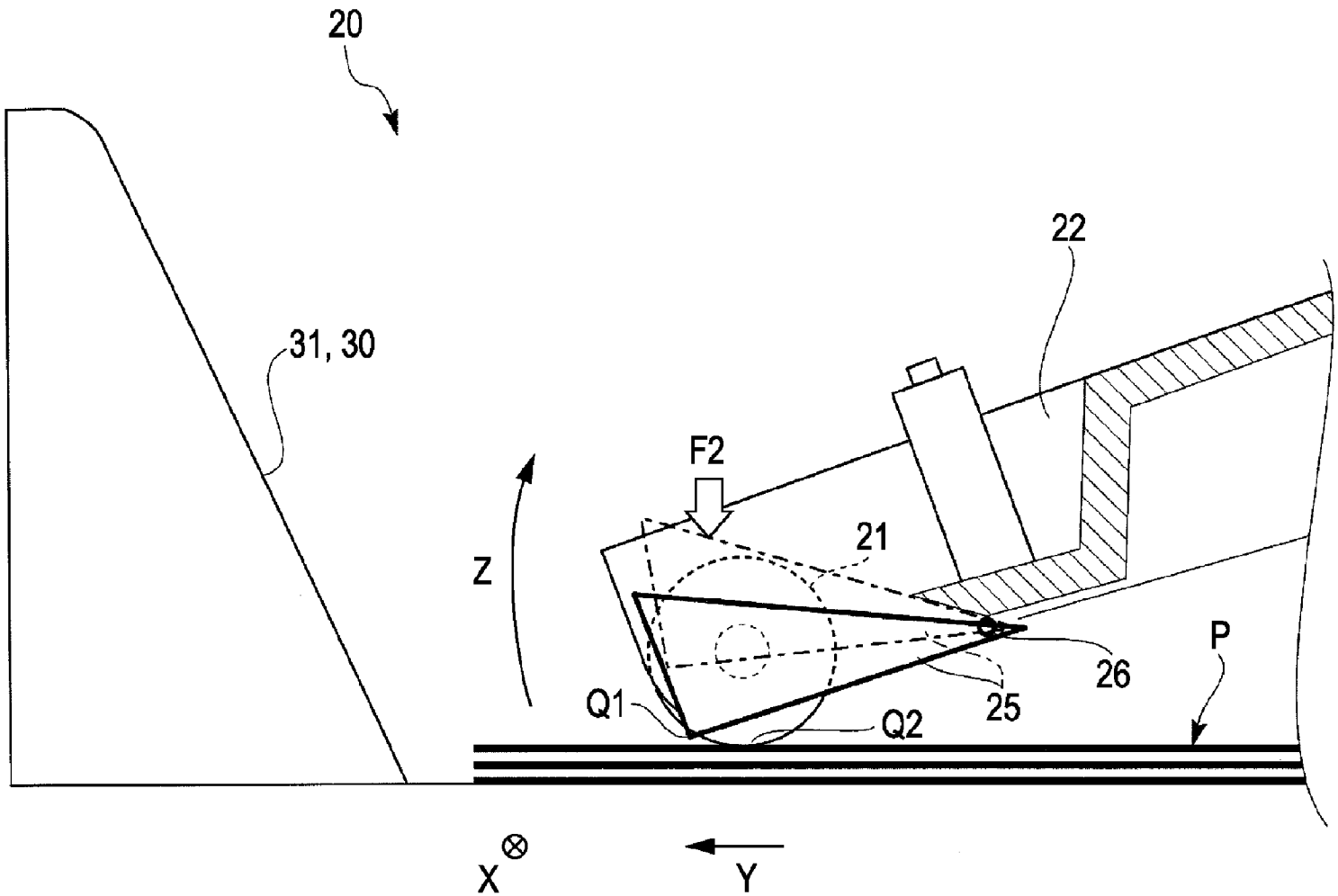
FIG. 10 is a side view illustrating an operation of a paper sheet regulation unit according to the invention.
Figure 11:
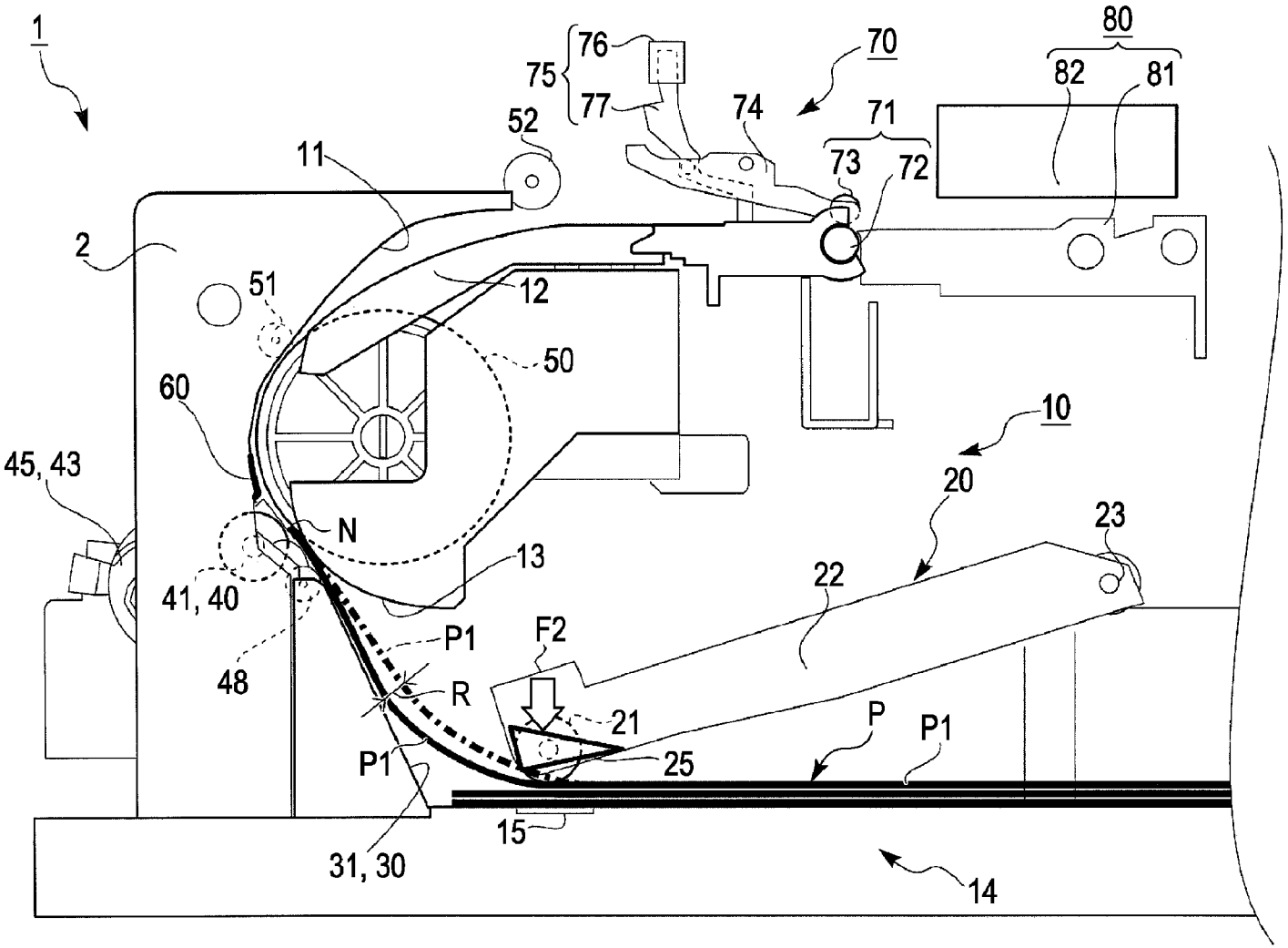
FIG. 11 is a side view illustrating an operation of the paper sheet regulation unit inside the printer according to the invention.
Figure 12:
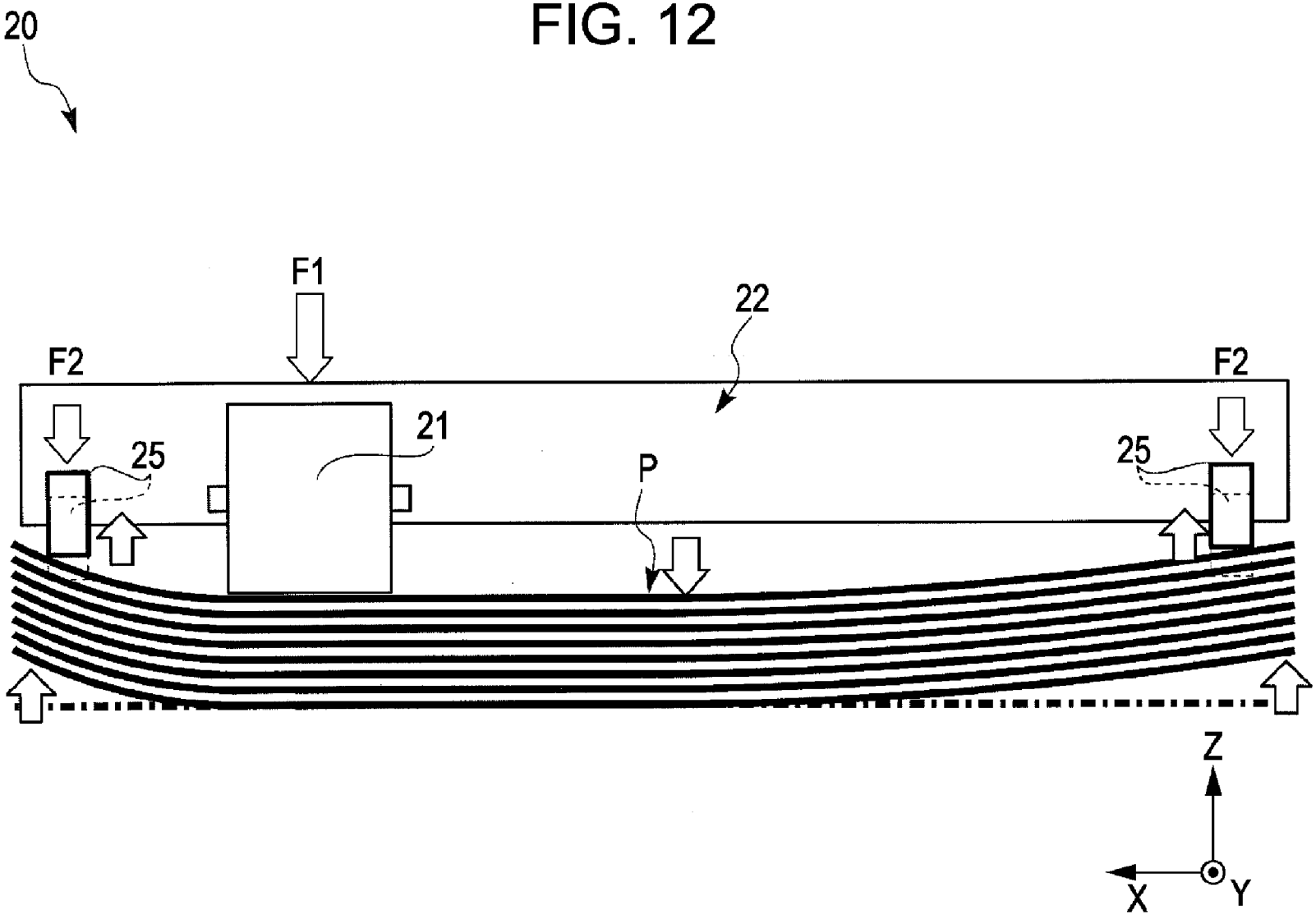
FIG. 12 is a front view illustrating an operation of the paper sheet regulation unit according to the invention when viewed from a downstream side of a feeding direction.

FIG. 9 is an overall bottom perspective view illustrating the arm unit according to the invention. FIG. 10 is a side view illustrating an operation of the paper sheet regulation unit according to the invention. FIG. 11 is a side view illustrating an operation of the paper sheet regulation unit in the printer according to the invention. FIG. 12 is a front view illustrating an operation of the paper sheet regulation unit according to the invention when viewed from a downstream side of a feeding direction.

As illustrated in FIG. 9, a plurality of paper sheet regulation units 25 are provided in the arm unit 22 in a widthwise direction X. The paper sheet regulation units 25 are retained so as to be swingable about the shafts 26. The plurality of paper sheet regulation units 25 are provided at locations facing the inner side of both widthwise side ends of paper sheet P of a predetermined size in a widthwise direction X. The plurality of paper sheet regulation units 25 are urged by urging forces F2 (refer to FIG. 12) of the urging spring (not shown) in a direction of approaching the loaded paper sheets P.

As illustrated in FIG. 10, the paper sheet regulation units 25 are provided so as to be swingable about the shafts 26.

Here, the lowermost ends of the paper sheet regulation units 25 in the direction of paper sheet are indicated by a reference numeral Q1. The lowermost point of the pickup roller 21 in the direction of paper sheet is indicated by a reference numeral Q2. The contact/separation direction of the paper sheet regulation units 25 with respect to the paper sheet P is indicated by an arrow Z.

When the paper sheet regulation units 25 do not contact with the paper sheet P, the locations of the lowermost ends Q1 of the paper sheet regulation units 25 are on the upper side of the lowermost point Q2 of the pickup roller 21 in a contact/separation direction Z, where the paper sheet regulation units 25 are moved away from the paper sheet P.

On the other hand, when the paper sheet regulation units 25 contact with the paper sheet P, the paper sheet regulation units 25 swing about the shafts 26 in a clockwise direction of FIG. 10 against the urging forces F2 (refer to FIG. 12) of urging springs (not shown). In other words, the paper sheet regulation units 25 are retreated from the paper sheet P in a direction of moving away from the paper sheet P. The paper sheet regulation units 25 contact with a regulation unit (not shown) provided in the arm unit 22 at a location indicated by a dashed dotted line.

As illustrated in FIGS. 11 and 12, the paper sheet regulation units 25 make contact with the lifted paper sheet P and retreat upward to reduce the lift of the paper sheet P. Therefore, a feeding path difference R (also referred to as 'posture difference' or 'transport difference') (refer to FIG. 11) between one end P (indicated by a dashed dotted line), the other end, and the center P (indicated by a solid line) in a widthwise direction X of the paper sheet P can be reduced. As a result, the skew due to the feeding path difference R can be reduced. In particular, since the paper sheet P of a large size, that is, the paper sheet P of A3 size or more is apt to be skewed due to the lift phenomenon, the paper sheet regulation units 25 herein are effective.

As in the embodiment of the invention, the printer 1 of a front feeding type or a front supply type has a U-shaped guide path from the pickup roller 21 to the transport roller unit 71. The printer 1 according to the embodiment of the invention has a guide path longer than that of a printer of a rear feeding type or a rear supply type. Since a skew due to the lift phenomenon is apt to occur when the guide path is long, the paper sheet regulation units 25 herein are effective.

In the embodiment of the invention, the pickup urging force F1 that urges the pickup roller 21 in a direction of approaching the paper sheet P by using the arm unit 22 is 100 to 300 gram-weight. The regulation urging force F2 that urges the paper sheet regulation units 25 in a direction of approaching the paper sheet P with respect to the arm unit 22 is 20 to 30 gram-weight. Therefore, even when the lifting forces of the paper sheet P are different according to the type of paper sheet, the lift phenomenon of the paper sheet P can be reduced.

Then, the lifting force of the paper sheet P can be absorbed by damping the regulation urging force F2. Therefore, the possibility of pushing up the entire arm units is reduced. In other words, the pickup roller 21 is prevented from moving away from the paper sheet P by the lift phenomenon of the paper sheet P. As a result, the paper sheet P can be reliably picked up to be sent to a downstream side of a feeding direction.

In other words, although an upward force is applied to the arm unit 22 by damping the lifting force of the paper sheet P by the regulation urging force F2, since the magnitude of the regulation urging force F2 is much smaller than the magnitude of the pickup urging force F1, the upward force rarely influences the pickup urging force F1. Therefore, the pickup roller 21 can reliably picks up the paper sheet P to send the paper sheet P to a downstream side of a feeding direction using the pickup urging force F1.

The magnitude of the regulation urging force F2 may be adjusted according to the type of paper sheet. For example, when a stiffer paper sheet than a normal paper sheet is selected, the paper sheet regulation units 25 may be urged by a plate spring (not shown) together with the urging springs (not shown). Furthermore, a plate spring (not shown) may be applied to the paper sheet regulation units 25 in multi-stages according to the retreated amount of the paper sheet regulation units 25. In this relation, the lifting phenomenon of the general soft paper sheet may be regulated by a small force, and the lifting phenomenon of the stiff paper sheet may be regulated by a large force.

Although the paper sheet regulation units 25 are provided together with the arm unit 22 retaining the pickup roller 21, they may be provided as a separate member from the arm unit 22 retaining the pickup roller 21. In this case, a force that pushes up the arm unit 22 may not be applied to the arm unit 22 at all by damping the lifting force of the paper sheet P using the regulation urging force F2.

In the embodiment of the invention, since the paper sheet regulation units 25 are provided together with the arm unit 22 retaining the pickup roller 21, the paper sheet regulation units 25 can be moved away from the paper sheet P together with the pickup roller 21 when the cassette unit 14 is attached or detached. Therefore, the attaching or detaching operation of the cassette unit 14 may not be prevented.

The feeding unit 10 as the feeding device according to the embodiment includes a pickup roller 21 picking up the paper sheet P as an example of a loaded feeding medium and sending the paper sheet P to a downstream side of a feeding direction and the paper sheet regulation units 25 provided at locations different from the pickup roller 21 in a widthwise direction X of the paper sheet P and regulating the posture of the paper sheet P as a regulator by moving relative to the pickup roller 21 so as to contact with or separate from the loaded paper sheet P in a contact/separation direction Z and being urged in a direction of approaching the paper sheet P.

In the embodiment of the invention, the paper sheet regulation units 25 are provided at locations facing both side ends of the paper sheet P having a predetermined size in a widthwise direction X of the paper sheet P so as to serve as a regulator.

In the embodiment of the invention, the paper sheet regulation units 25 are provided in the arm unit 22 as the pickup unit holding a pickup roller 21 so that the pickup roller can contact with or separate from the paper sheet P, the paper sheet regulation units 25 being movable relative to the arm unit 22.

In the embodiment of the invention, the lowermost end Q1 of the paper sheet regulation units 25 on the side of the paper sheet is retreated from the paper sheet P relative to the lowermost point Q2 of the pickup roller 21 on the side of the paper sheet in a contact/separation direction Z.

In the embodiment of the invention, urging forces urging the paper sheet regulation units 25 are variable.

In the embodiment of the invention, there are provided the U-shaped outer paper sheet guide unit 11 as the guide path unit guiding the paper sheet P sent by the pickup roller 21, the inner paper sheet guide unit 12, the introduction prevention unit 13, and the bank separation unit 31. The U-shaped outer paper sheet guide unit 11, the inner paper sheet guide unit 12, the introduction prevention unit 13, and the bank separation unit 31 constitute the U-shaped feeding path when viewed from a side.

The printer 1 as an example of the printing apparatus according to the embodiment of the invention includes the feeding unit 10 picking up and feeding the paper sheet P as an example of the loaded recording medium, the transport unit 70 transporting the fed paper sheet P toward a downstream side in a transportation direction, and the printing unit 80 performing a printing operation on the transported paper sheet P by the printing head 82.

Other Embodiments

Figure 13:
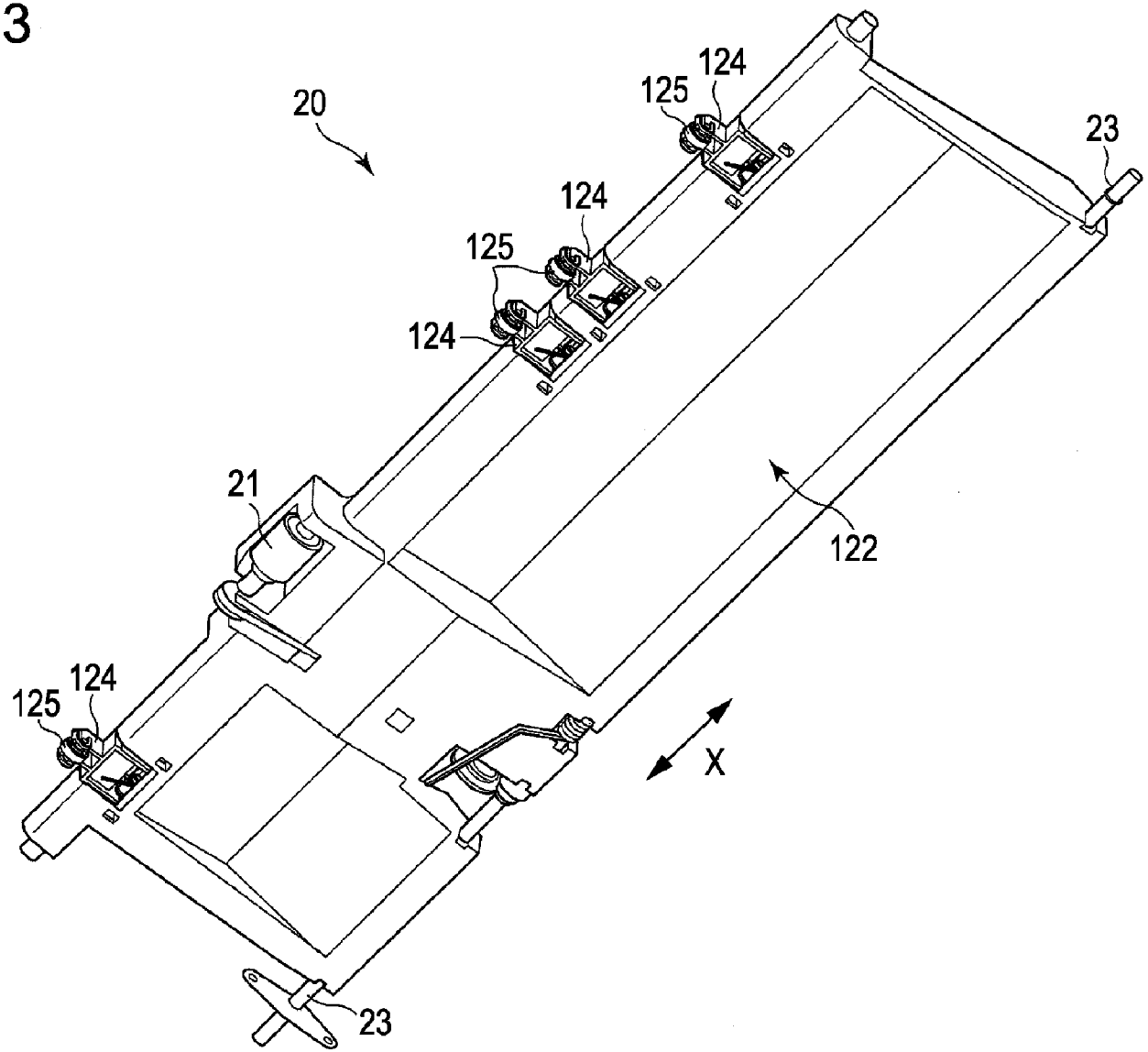
FIG. 13 is an overall bottom perspective view illustrating an arm unit according to other embodiments of the invention.
Figure 14:
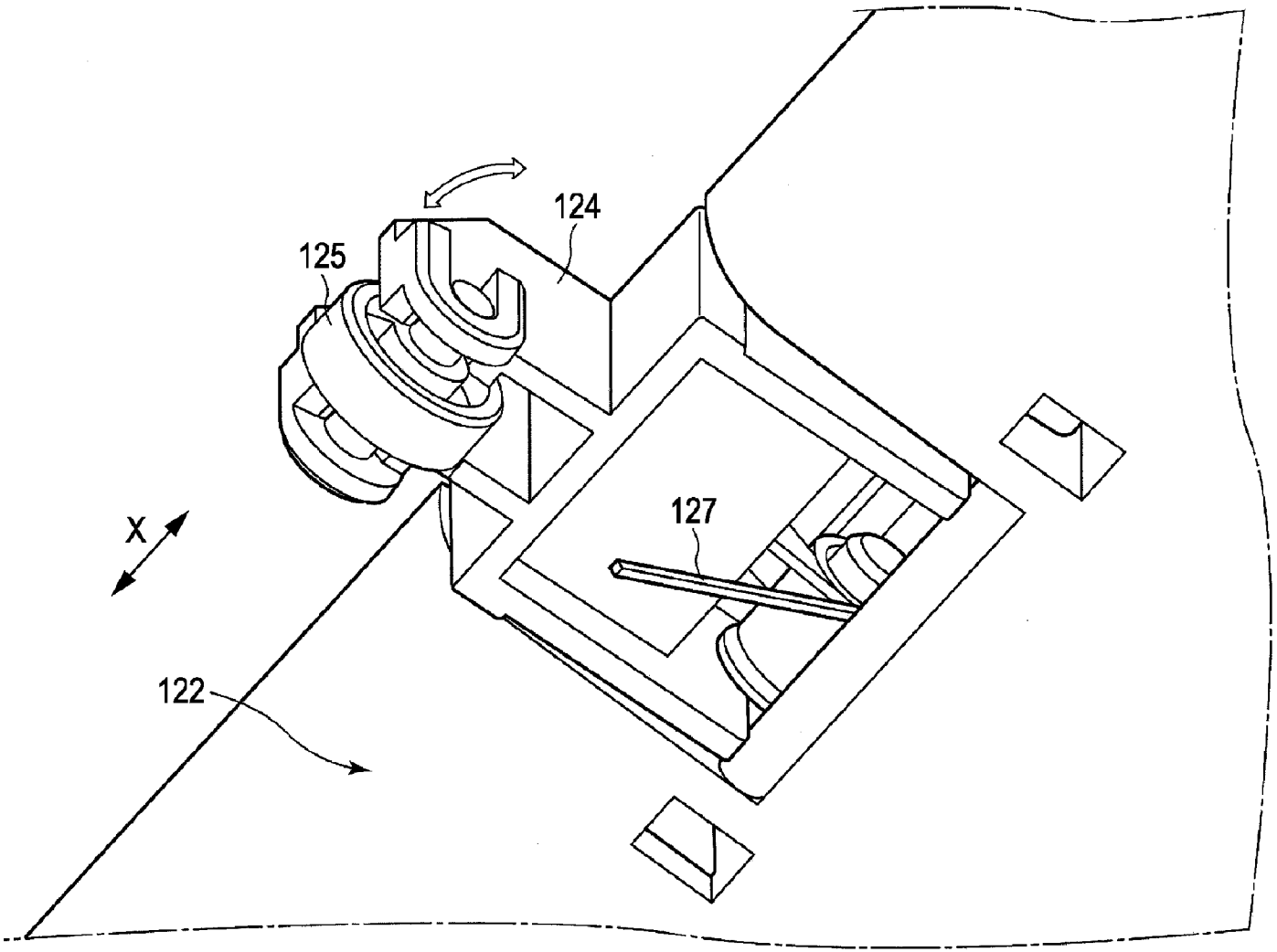
FIG. 14 is an enlarged bottom perspective view illustrating a regulation roller according to the other embodiments of the invention.
Figure 15A:
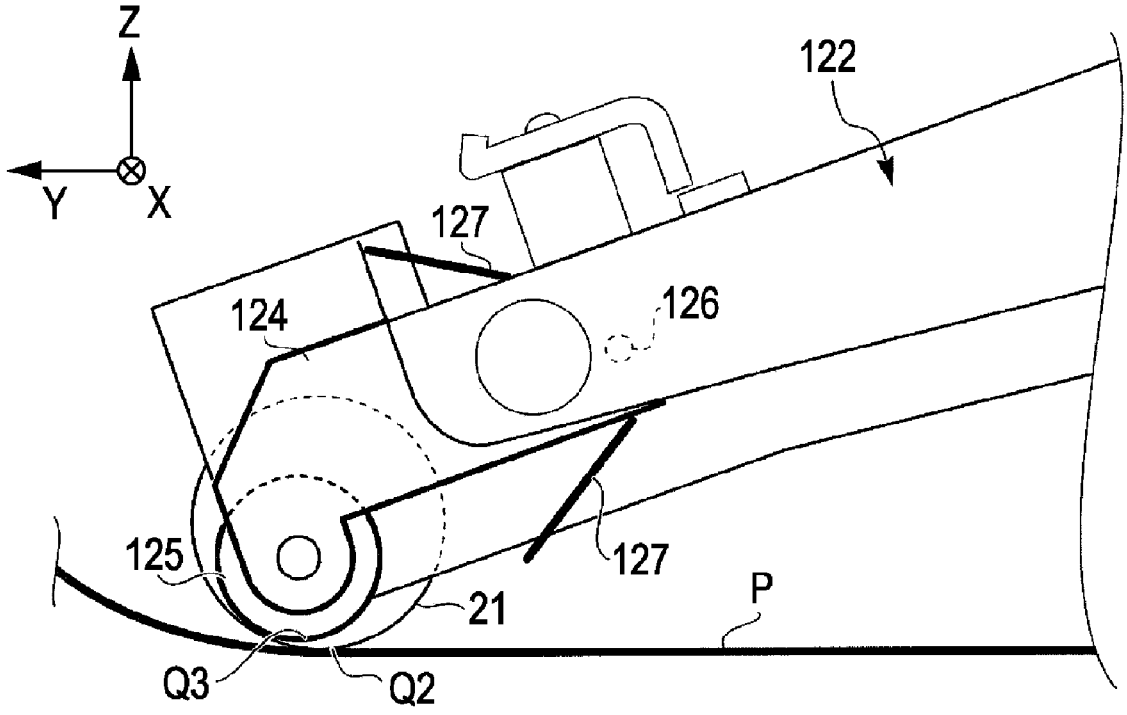
FIGS. 15A and 15B are side views illustrating an operation of the regulation roller according to the other embodiments of the invention.
Figure 15B:
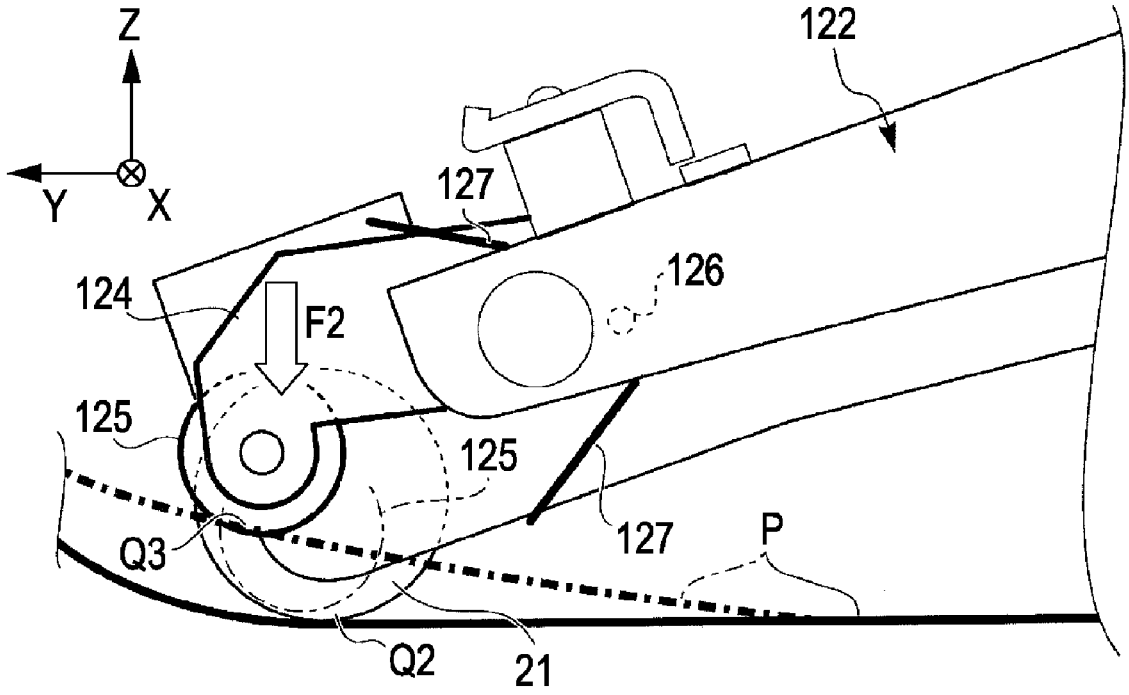
Figure 16A:
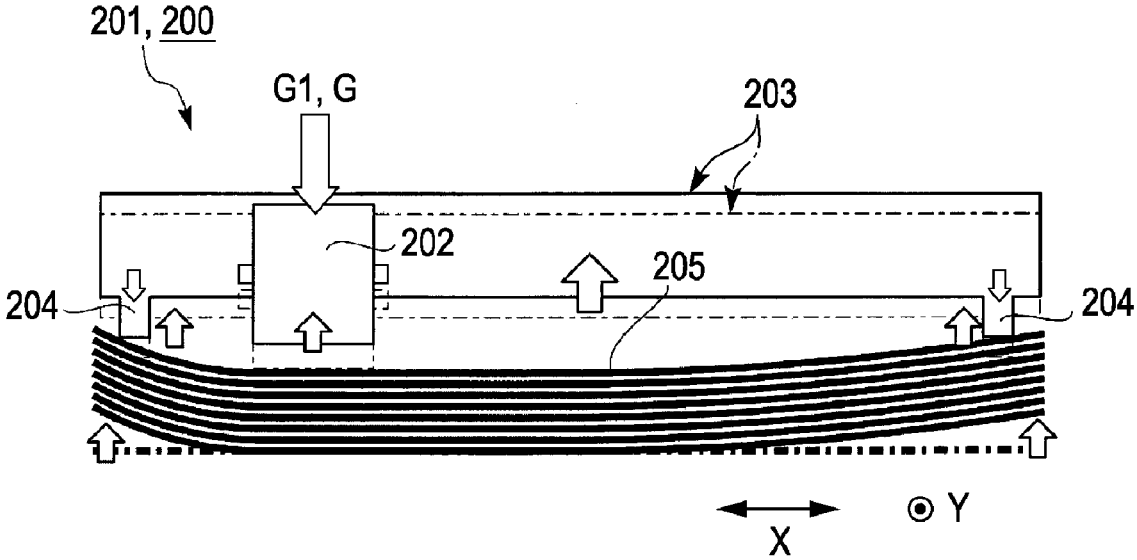
FIGS. 16A and 16B are front views illustrating a schematic configuration inside a known printing apparatus when viewed from a downstream side of a feeding direction.
Figure 16B:
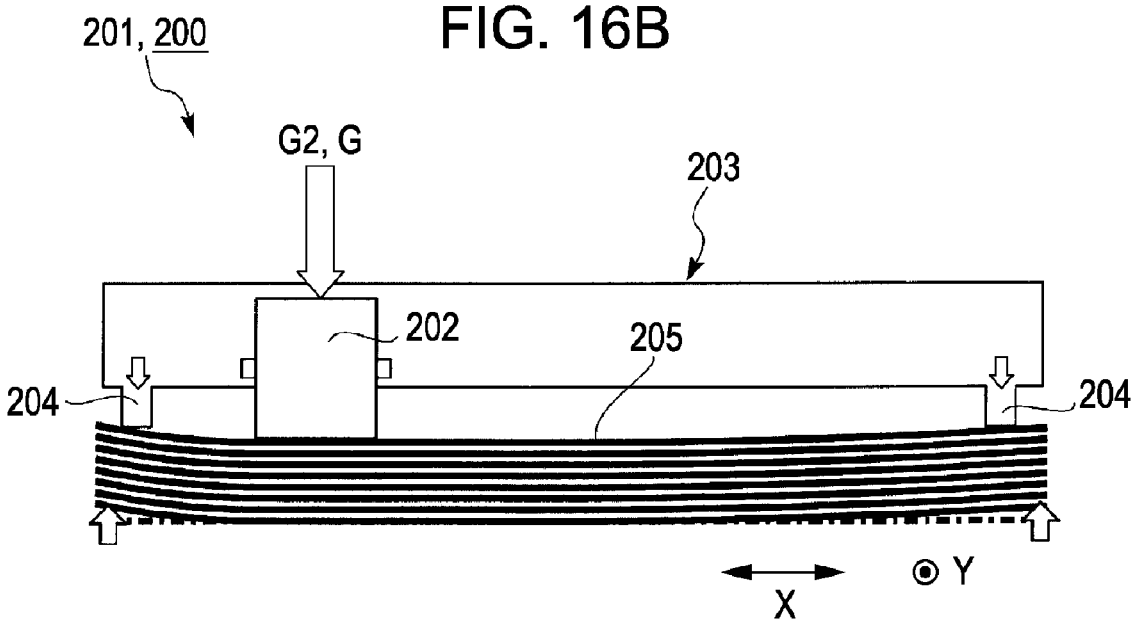

FIG. 13 is an overall bottom perspective view illustrating an arm unit according to the other embodiments of the invention. FIG. 14 is an enlarged bottom perspective view illustrating a regulation roller according to the other embodiments of the invention. FIGS. 15A and 15B are side views illustrating an operation of the regulation roller according to the other embodiments of the invention.

As illustrated in FIGS. 13 to 15A and 15B, a plurality of regulation rollers 125 are provided in an arm unit 122 in a widthwise direction X of the paper sheet P. The regulation rollers 125 are rotatably retained by roller holders 124. The roller holders 124 are retained by the arm unit 122 so as to be swingable about holder shafts 126.

The plurality of regulation rollers 125 are located in the vicinity of the inside of both side ends in a widthwise direction X of the paper sheet P having a predetermined size. The regulation rollers 125 are urged by urging forces F2 of torsion coil springs 127 (refer to FIGS. 14 and 15) in a direction of approaching the loaded paper sheet P.

Since the other components are the same as those of the above-described embodiment of the invention, the same reference numerals are used and a detailed description thereof will be omitted.

As illustrated in FIGS. 15A and 15B, the regulation rollers 125 and the roller holders 124 are provided so as to be swingable about the holder shafts 126.

Here, the lowermost points of the regulation rollers 125 on the side of the paper sheet are indicated by a reference numeral Q3.

When the regulation rollers 125 in FIG. 15A do not contact with the paper sheet P, the lowermost points Q3 of the regulation rollers 125 are located on the upper side of the lowermost point Q2 of the pickup roller 21 in a contact/separation direction Z, that is, on a side moved away from the paper sheet P.

Meanwhile, when the regulation rollers 125 of FIG. 15B contact with the paper sheet P, the regulation rollers 125 swing in a clockwise direction of the drawing about the holder shafts 126 against the urging forces F2 of the torsion coil springs 127. In other words, the regulation rollers 125 are retreated in a direction of moving away from the paper sheet P. Therefore, the same advantage as the paper sheet regulation units 25 of the above-described embodiment can be obtained by the regulation rollers 125.

In the other embodiments of the invention, since the regulation rollers 125 are provided, a frictional force between the paper sheet P and the regulation rollers 125 (the paper sheet regulation units 25 in the above-described embodiment of the invention) can be reduced as compared with the above-described embodiment of the invention. Therefore, a back tension can be reduced in a feeding process of sending the paper sheet P to a downstream side of a feeding direction. Furthermore, as compared with the above-described embodiment of the invention, the possibility of causing a defect on a surface of the paper sheet P by the regulation rollers 125 (the paper sheet regulation units 25 in the above-described embodiment of the invention) can be reduced. In addition, since a back tension can be reduced, a skew can be reduced as compared with the above-described embodiment of the invention.

In the other embodiments of the invention, the regulation units that regulate the posture of the paper sheet P by being urged in a direction of approaching the paper sheet P so as to contact with or separate from the paper sheet P in a contact/separation direction Z are the rotatable regulation rollers 125.

The present invention is not limited to the above-described embodiments, and may be modified into various forms without departing from the scope of the invention according to the appended claims. Of course, the modification is also included in the scope of the invention.

What is claimed is:

1. A feeding device comprising:

a pickup unit which is configured to pivot towards and away from a loaded feeding medium, the pickup unit including:

an arm unit that rotates around an arm shaft formed in a first end of the arm unit;

a pickup roller formed in a second end of the arm unit which is opposite to the first end, the pickup roller being configured to pick up the loaded feeding medium and send the feeding medium to a downstream side of a feeding direction; and a regulator that is provided in the second end of the arm unit at a location different from the pickup roller in a widthwise direction of the feeding medium and regulates the posture of the feeding medium by rotating around a regulator shaft which is formed in the widthwise direction of the feeding medium which is urged in a direction of approaching the feeding medium, the regulator moving from a first position where the regulator comes into contact with and regulates the loaded feeding medium to a second position where the regulator is located away from the loaded feeding medium, the first position being retreated further from the loaded feeding medium than the a location of the pickup roller in the direction of approaching the feeding medium, the second position being retreated further from the loaded feeding medium than the first position in the direction of approaching the feeding medium, wherein when the regulator comes into contact with the loaded feeding medium, the regulator pivots around the regulator shaft so as to be positioned at a position which is further from the feeding medium than the pickup roller in the direction that the pickup unit pivots towards and away from the loaded feeding medium.

2. The feeding device of claim 1, wherein when the loaded feeding medium is sent to the downstream side of the feeding direction, the loaded feeding medium is fed by a transport unit and the pickup unit is caused to pivot away from the loaded feeding medium to the second position such that the pickup unit does not contact the loaded feeding medium.

* * * * *